US005673670A

United States Patent [19]

Powell et al.

[11] Patent Number: 5,673,670

[45] Date of Patent: Oct. 7, 1997

[54] RETURNLESS FUEL DELIVERY SYSTEM

[75] Inventors: Alvin Arthur Powell, Burton; James Witherspoon Mitchell, Jr., Wayne; Robert Eugene Wattleworth, Canton, all of Mich.; Kyle Lance Petrich, Minneapolis, Minn.; Brian Michael Blanton, Dearborn, Mich.

[73] Assignee: Ford Motor Company, Dearborn, Mich.

[21] Appl. No.: 498,205

[22] Filed: Jul. 5, 1995

[51] Int. Cl.[6] ..... F02M 41/00

[52] U.S. Cl. ..... 123/463; 123/497; 137/510; 137/907

[58] Field of Search ..... 123/463, 497, 123/456, 457; 137/510, 907; 251/118

[56] References Cited

U.S. PATENT DOCUMENTS

| | | | |
|---|---|---|---|
| 1,518,984 | 12/1924 | Kien . | |
| 2,090,781 | 8/1937 | Camner . | |
| 2,348,388 | 9/1944 | Jenkins . | |
| 3,921,664 | 11/1975 | Almquist . | |
| 4,237,924 | 12/1980 | Benjamin et al. . | |
| 4,431,026 | 2/1984 | Fehrenbach et al. . | |
| 4,625,696 | 12/1986 | Radaelli | 123/463 |
| 4,627,463 | 12/1986 | Johnstone . | |
| 4,653,528 | 3/1987 | Field et al. . | |
| 4,741,360 | 5/1988 | Affeldt et al. . | |
| 4,903,667 | 2/1990 | Sonnenmoser et al. . | |
| 4,936,342 | 6/1990 | Kojima et al. . | |
| 5,044,344 | 9/1991 | Tuckey et al. . | |
| 5,111,793 | 5/1992 | Deeds . | |
| 5,113,831 | 5/1992 | Grant . | |
| 5,148,792 | 9/1992 | Tuckey | 123/497 |
| 5,163,472 | 11/1992 | Takada et al. . | |
| 5,193,576 | 3/1993 | Mosby . | |
| 5,213,126 | 5/1993 | Ono et al. . | |
| 5,220,941 | 6/1993 | Tuckey . | |
| 5,237,975 | 8/1993 | Betki et al. . | |
| 5,265,644 | 11/1993 | Tuckey . | |
| 5,279,327 | 1/1994 | Alsobrooks et al. . | |
| 5,291,822 | 3/1994 | Alsobrooks et al. . | |
| 5,339,785 | 8/1994 | Wilksch . | |
| 5,361,742 | 11/1994 | Briggs | 123/497 |
| 5,381,816 | 1/1995 | Alsobrooks | 123/463 |
| 5,398,655 | 3/1995 | Tuckey . | |
| 5,413,027 | 5/1995 | Hornby | 123/463 |
| 5,458,104 | 10/1995 | Tuckey | 123/463 |

FOREIGN PATENT DOCUMENTS

| | | |
|---|---|---|
| 29 12 799 A | 3/1979 | Germany . |
| 62-225763A | 10/1987 | Japan . |
| 5-263732A | 10/1993 | Japan . |

OTHER PUBLICATIONS

Five photographs of a Purolator brand fuel pressure regulator, effective date unknown.

*Primary Examiner*—Carl S. Miller
*Attorney, Agent, or Firm*—Mark S. Sparschu

[57] ABSTRACT

In one embodiment of the present invention, a "returnless" fuel system for a motor vehicle is disclosed. A "series-pass" fuel pressure regulator in the system provides fuel of a regulated pressure to a fuel rail comprising at least one fuel injector. A "bypass" fuel pressure regulator provides fuel with a regulated pressure to the series pass regulator. An in-line fuel filter is located downstream from the bypass regulator, such that only the fuel which reaches the series-pass regulator is filtered. A check valve is located downstream from the bypass regulator as well, to prevent fuel pressure bleed-down through the fuel pump and the bypass regulator. A pressure relief valve is coupled to allow fuel with a pressure above a predetermined value to flow around the check valve.

9 Claims, 1 Drawing Sheet

RETURNLESS FUEL DELIVERY SYSTEM

BACKGROUND OF THE INVENTION

1. Field of the Invention

The present invention relates to fuel delivery systems for motor vehicles, and more particularly to returnless fuel delivery systems for motor vehicles.

2. Description of the Related Art

In the continuing effort to reduce evaporative emissions from motor vehicles, "returnless" fuel systems are seen as a promising way to do so. A conventional fuel system has a fuel line connecting a fuel pump with a fuel rail on the engine of the motor vehicle. Connected to the fuel rail are one or more fuel injectors. A second fuel line runs from a bypass fuel pressure regulator on the fuel rail to the fuel tank of the motor vehicle to return unused fuel to the fuel tank. This fuel that returns to the fuel tank has often been heated by the heat of the engine, by exhaust heat and by heat from the underbody of the vehicle. One disadvantageous result from an emissions standpoint is the accumulation of fuel vapor in the fuel tank due to the return of heated fuel.

Returnless fuel systems eliminate the fuel line which returns fuel from the fuel rail to the fuel tank. Instead, the fuel system is designed to supply the proper amount of fuel to the fuel rail, so there is no excess.

One proposed returnless fuel system is disclosed in U.S. Pat. No. 5,044,344, issued to Tuckey et al. In this system, the speed of a fuel pump motor is controlled in accordance with feedback from a fuel pressure sensor. Although such a system may generally be effective, alternative systems may be more economical than an electronic system. Further, other systems may be able to respond more quickly to transient conditions than a system which operates based on controlling the speed of a fuel pump.

SUMMARY OF THE INVENTION

The present invention provides a fuel delivery system. The fuel delivery system comprises a fuel pump having an outlet through which the fuel pump delivers fuel. Also, the system includes at least one fuel injector coupled to receive at least a portion of the fuel delivered from the outlet of the fuel pump. Further, the system includes a first fuel pressure regulator coupled to regulate fuel pressure to the at least one fuel injector. Additionally, the system comprises a second fuel pressure regulator coupled to regulate fuel pressure at the outlet of the fuel pump.

The present invention also provides a system comprising a fuel pump, a "series-pass" fuel pressure regulator coupled to receive fuel from the fuel pump, and at least one fuel injector coupled to receive fuel from the "series-pass" fuel pressure regulator.

The present invention, by providing substantial elimination of electronic control from the fuel system, has the potential to be a very economical system. Further, the system can respond quickly to transient conditions. Thus, the present invention can provide advantages over the prior art.

DETAILED DESCRIPTION OF THE PREFERRED EMBODIMENT

Figure 1:
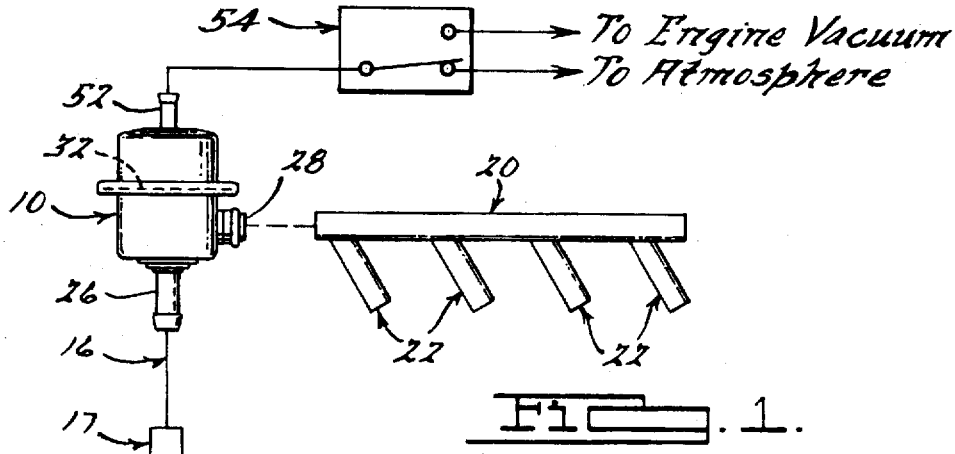
FIG. 1 is a schematic drawing showing a returnless fuel system of a motor vehicle.

Referring to FIG. 1, a returnless fuel system for a motor vehicle is illustrated. Pressure regulator 10 is a "series-pass" type of pressure regulator. That is, pressure regulator 10 is preferably used in series in a fuel line, to regulate the fuel pressure at the outlet of the regulator. Such a "series-pass" fuel regulator is of particular advantage in a so-called "returnless" fuel system.

The fuel system of FIG. 1 includes a fuel tank 12, fuel pump 14, fuel line 16, in-line fuel filter 17, pressure regulator 10, fuel rail 20 and one or more fuel injectors 22. Pressure regulator 10 is preferably directly connected to fuel rail 20, without an intermediate fuel line. The defining characteristic of "returnless" fuel systems is that there is no fuel line returning unused fuel from fuel rail 20 to fuel tank 12. When turned on, fuel pump 14 is preferably coupled to a nominally-constant voltage (e.g., ignition voltage, nominally 12 volts) for operation at a substantially-constant speed. Fuel pump 14 is preferably capable of providing fuel at relatively high pressure (for example, about 70 pounds per square inch).

Further, a bypass-type fuel pressure regulator 23 can be employed to provide a regulated fuel pressure in fuel line 16 for series-pass regulator 10. Bypass regulator 23 can be of any conventional design known to the art. Examples of some such bypass regulator designs are found in U.S. Pat. No. 5,163,472, issued to Takada et al.; U.S. Pat. No. 5,193,576, issued to Mosby; and U.S. Pat. No. 4,936,342, issued to Kojima et al. Bypass regulator 23 regulates the pressure at its input 23A and returns excess fuel from fuel pump 14 via outlet 23B to fuel tank 12. The use of such a bypass regulator 23 is preferable to the alternative of using a simple pressure relief valve because a bypass regulator will provide superior fuel pressure regulation at a wider range of fuel flow rates. Bypass regulator 23 is designed to regulate the pressure at its input 23A to provide a high enough pressure for pressure regulator 10 to operate.

Additionally, a check valve 25 can be provided in order to hold pressure in fuel line 16 when fuel pump 14 turns off. Check valve 25 can be located as shown, downstream from inlet 23A of bypass regulator 23, if pressure bleed-down through bypass regulator 23 is a concern. Such bleed-down can occur, for example, through fuel contaminants which may be trapped in bypass regulator 23, holding bypass regulator 23 partially open after fuel pump 14 turns off. With check valve 25 located downstream from bypass regulator 23 as shown, pressure relief valve 27 is preferably also employed. As will be described in detail below, pressure relief valve 27 facilitates the relief of overpressure conditions in fuel rail 20. Preferably, check valve 25 and pressure relief valve 27 are both of the simple ball-and-spring variety. Also, check valve 25 and pressure relief valve 27 can be integrated into a single assembly 29. Such an assembly is disclosed in co-pending U.S. patent application Ser. No. 08/287,034, filed Aug. 8, 1994, the disclosure of which is hereby incorporated by reference.

To minimize fuel line connections outside fuel tank 12, bypass regulator 23, check valve 25 and pressure relief valve 27 are preferably located within fuel tank 12. Of course, if immersed in gasoline when so located, these components must be constructed of materials which can withstand such immersion.

Check valve 25 can alternatively be integrated into fuel pump 14 if fuel pressure bleed-down through bypass regulator 23 is not a significant likelihood. In that event, pressure relief valve 27 can be eliminated.

One skilled in the art will recognize that the location of fuel filter 17 as shown in FIG. 1 results in fuel filter 17 filtering only that fuel which reaches pressure regulator 10 for consumption by the engine. That is, any other fuel is returned to fuel tank 12 by bypass regulator 23. Thus, the life of fuel filter 17 is enhanced over fuel delivery systems which filter all fuel pumped by the system's fuel pump.

Figure 2:
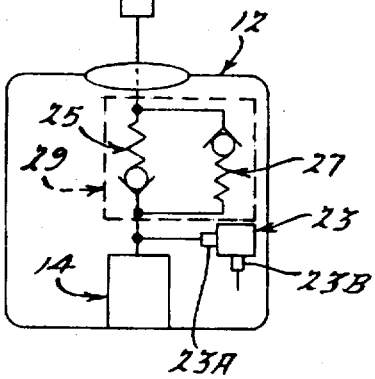
FIG. 2 is a sectional view of fuel pressure regulator 10 of FIG. 1.
Figure 2:
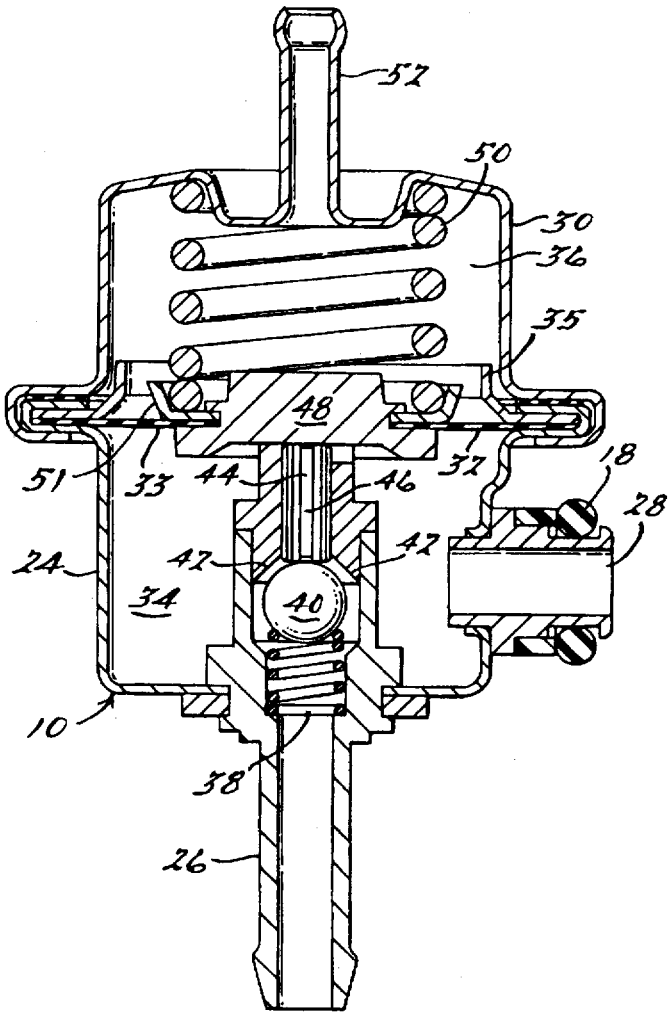

Referring additionally to FIG. 2, fuel pressure regulator 10 will be described in detail. Pressure regulator 10 includes a housing 24, from which extend fuel inlet 26 and fuel outlet 28. The periphery of a diaphragm assembly 32 and a crimp ring 35 are crimped onto housing 24. A cover 30 is also crimped onto housing 24, with the inclusion of suitable gasket material to prevent leaks through the crimped joint. Diaphragm assembly 32 defines a lower chamber 34 and an upper chamber 36 within pressure regulator 10. Diaphragm assembly 32 includes a flexible diaphragm 33.

Downstream from fuel inlet 26 is valve spring 38. Valve spring 38 is a compression spring which exerts force in the upward direction as viewed in FIG. 2. Valve spring 38 bears against valve ball 40. Valve ball 40 is disposed in opposition to valve seat 42.

Valve seat 42 is located at one end (the lower end as viewed in FIG. 2) of fuel passage 44. As can be seen in FIG. 2, if valve ball 40 is moved upward to seat against valve seat 42, fuel passage 44 will be sealed against flow of fuel from fuel inlet 26.

Figure 3:
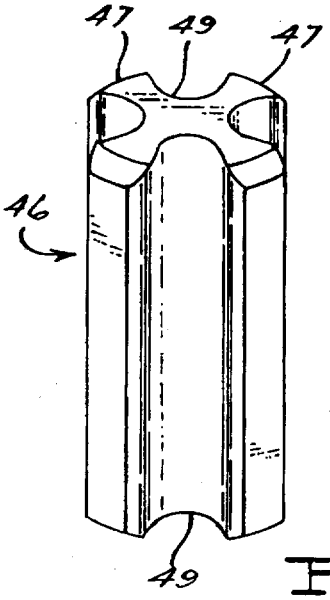
FIG. 3 is a perspective view of fluted pin 46 of FIG. 2.

Disposed within fuel passage 44 is a fluted pin 46. Fluted pin 46 is illustrated in detail with additional reference to FIG. 3. In this embodiment of the present invention, fluted pin 46 has four lobes 47 and four axial flutes 49. Fluted pin 46 is designed to be rigid, preferably being made from metal.

Fluted pin 46 has an outside diameter across lobes 47 which is only slightly smaller than the diameter of fuel passage 44. As a result, fluted pin 46 is laterally supported by fuel passage 44. This lateral support promotes repeatability of operation of pressure regulator 10. Flutes 49 make fluted pin 46 porous to fuel flow through fuel passage 44. Therefore, if valve ball 40 is not seated against valve seat 42, fuel can flow upward past fluted pin 46 and into lower chamber 34 of pressure regulator 10.

Diaphragm assembly 32 includes a body 48, the lower side of which bears against the upper end of fluted pin 46. Bearing against the upper side of diaphragm assembly 32 is a main spring 50, seated in a seat 51. Main spring 50 is located in upper chamber 36 of pressure regulator 10. Main spring 50 is in compression, thereby exerting a force which resists upward movement of diaphragm assembly 32.

In the preferred embodiment of the present invention, fluted pin 46 is mechanically coupled neither to diaphragm assembly 32 nor to valve ball 40. Fluted pin 46 merely bears against each of these components. Such a configuration has the advantage that close tolerances need not be maintained in the production of pressure regulator 10. If fluted pin 46 were attached to either diaphragm assembly 32 or valve ball 40, precise alignment of these components would be important to prevent fluted pin 46 from becoming skewed in fuel passage 44. One result of such skewing could be increased friction preventing fluted pin 46 from moving up and down freely.

A further advantage of the use of valve ball 40 is that it is very inexpensive relative to alternative valve-stopper mechanisms.

Communicating with lower chamber 34 of pressure regulator 10 is the aforementioned fuel outlet 28.

A port 52 communicates with upper chamber 36 of pressure regulator 10. Port 52 can be left open, thereby exposing upper chamber 36 to atmospheric pressure, if it is desired that pressure regulator 10 regulate to a constant pressure in fuel rail 20. If instead it is desired for the pressure in fuel rail 20 to vary with manifold vacuum, thus resulting in a constant fuel pressure across fuel injectors 22, port 52 can be connected to a source of manifold vacuum. A further alternative is to connect port 52 to a pressure source switchable between atmosphere and manifold vacuum. Such a configuration could include a solenoid-actuated valve 54 controlled by the engine control computer of the vehicle. This configuration would allow the engine control computer to switch between constant rail pressure and constant injector pressure depending on driving conditions. For example, it may be desired to use constant injector pressure for normal driving conditions and constant rail pressure (presumably higher than the rail pressure during constant injector pressure mode) during hot operating conditions as an added measure to prevent fuel vaporization.

Whether operating at constant rail pressure or constant injector pressure, this system can maintain a relatively high and relatively consistent pressure in fuel rail 20 when compared to conventional fuel systems or alternative returnless fuel systems. The relatively high pressure maintained helps to prevent fuel vaporization in fuel rail 20. The relatively consistent pressure facilitates accurate fuel delivery control.

Fuel pressure regulator 10 operates as follows. With the entire fuel system unpressurized, the force of main spring 50 overcomes the force of valve spring 38. Thus, valve ball 40 is forced down by fluted pin 46 such that fuel flow can occur from fuel inlet 26 to fuel outlet 28 (that is, the valve comprising valve ball 40 and valve seat 42 is fully open). When fuel pump 14 begins to pump fuel, that fuel accordingly flows through pressure regulator 10 to fuel rail 20. Notice that even in its most downward position, body 48 of diaphragm assembly 32 does not seal the top of fuel passage 44.

Once the fuel pressure in lower chamber 34 approaches the pressure at which pressure regulator 10 is designed to regulate, the fuel pressure in lower chamber 34 will cause diaphragm assembly 32 to deflect upward. When this occurs, valve spring 38 forces valve ball 40 toward valve seat 42. This reduces the fuel flow through fuel passage 44, thereby reducing the pressure in lower chamber 34. If the fuel pressure in lower chamber 34 reaches a high enough pressure, through the fuel injectors 22 closing due to a hard deceleration or otherwise, valve ball 40 may fully close against valve seat 42.

When the fuel pressure in lower chamber 34 has reduced below the point at which pressure regulator 10 is designed to regulate, diaphragm assembly 32 can again move downward. When this occurs, fluted pin 46 pushes valve ball 40 away from valve seat 42, allowing greater fuel flow from fuel inlet 26 to fuel outlet 28 and increasing the pressure in lower chamber 34.

Through the ongoing process of fluted pin 46 and valve ball 40 moving upward and downward as necessary, the fuel pressure at fuel outlet 28 is maintained in regulation. When the engine in which this fuel system is installed is then turned off, a rise in pressure occurs in fuel rail 20. This rise occurs due to abrupt turning off of fuel injectors 22. This rise in pressure in fuel rail 20 is also present in lower chamber 34. Diaphragm assembly 32 is thus forced upward, closing the valve which comprises valve ball 40 and valve seat 42. Pressure regulator 10 thus acts to hold pressure in fuel rail 20 after the engine is turned off.

An additional feature of fuel pressure regulator 10 which may come into use at this time (that is, after the engine is turned off and the valve comprising valve ball 40 and valve seat 42 is closed) is an overpressure relief function. Overpressure in fuel rail 20 can be a concern if underhood temperatures are high (a so-called "hot soak" condition).

To allow the relief of such an overpressure condition, valve spring 38 is sized such that the following overpressure relief function will occur as necessary. The pressure in lower chamber 34 will act via passage 44 and against valve ball 40. (Note that body 48 is probably not in contact with fluted pin 46 at this time. Valve ball 40 was already in its fully upward position, and the pressure in lower chamber 34 has increased further due to the hot soak condition). If the force exerted by the pressure in lower chamber 34 is greater than the upward force exerted by valve spring 38 and the fuel pressure in fuel inlet 26, valve ball 40 will move downward a small amount. In this way, the overpressure in fuel rail is relieved, with pressure relief valve 27 also opening if the pressure in fuel line 16 rises sufficiently. Preferably, valve spring 38 is sized such that overpressure relief occurs when the pressure in lower chamber 34 is about five pounds per square inch above the pressure at fuel inlet 26.

A further feature of pressure regulator 10 is in diaphragm assembly 32 and main spring 50 acting as an accumulator to damp pressure spikes which occur in fuel rail 20 while the fuel system is operating. That is, diaphragm assembly 32 can move upward in the event of such pressure spikes. This movement is facilitated by the lack of mechanical attachment between diaphragm assembly 32, fluted pin 46 and valve ball 40.

As an example of one possible selection of components for the present system, fuel pump 14 can be a 70 pound-per-square-inch (psi) pump, bypass regulator 23 can be a 65 psi regulator and series-pass regulator 10 can be a 57 psi regulator.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A fuel delivery system comprising:

a fuel pump having an outlet through which said fuel pump delivers fuel;

at least one fuel injector coupled to receive at least a portion of the fuel delivered from the outlet of said fuel pump;

a first fuel pressure regulator coupled to regulate fuel pressure to said at least one fuel injector;

a second fuel pressure regulator coupled to regulate fuel pressure at the outlet of said fuel pump;

wherein said first fuel pressure regulator has an input and an output, said fuel pressure regulator is adapted to regulate the pressure at its output, said input is coupled to receive said at least a portion of the fuel delivered from the outlet of said fuel pump;

wherein said second fuel pressure regulator is adapted to regulate the pressure at an input of said second fuel pressure regulator, said input of said second fuel pressure regulator is coupled to receive fuel from said fuel pump before said first fuel pressure regulator;

further comprising an in-line fuel filter coupled between said fuel pump and said first fuel pressure regulator, and after said second fuel pressure regulator;

further comprising a check valve coupled between said fuel pump and said first fuel pressure regulator, and after said second fuel pressure regulator, said check valve oriented to prevent fuel flow through said check valve toward said fuel pump; and further comprising a pressure relief valve oriented to allow pressure relief for fuel above a predetermined pressure which would otherwise be blocked by said check valve.

2. A fuel delivery system as recited in claim 1, wherein said check valve and said pressure relief valve are coupled in parallel to one another.

3. A fuel delivery system comprising:

a fuel pump;

a first fuel pressure regulator with an input and an output, said input coupled to receive fuel from said fuel pump;

at least one fuel injector coupled to receive fuel from said output of said fuel pressure regulator;

wherein said first fuel pressure regulator further comprises an upper chamber and a lower chamber separated by a flexible diaphragm assembly; a fluid passage having a first end and a second end, said first end communicating with said lower chamber; a rigid member disposed within said fluid passage, said rigid member having a first end and a second end, said first end bearing against said diaphragm assembly, said rigid member further being porous to fluid flow through said fluid passage; a valve seat located at said second end of said fluid passage; a valve ball bearing against said second end of said rigid member; a valve spring exerting a force on said valve ball toward said valve seat; and a main spring exerting a force on said diaphragm assembly opposing movement of said diaphragm assembly toward said upper chamber; wherein said input is in communication with said fluid passage when said valve ball is away from said valve seat and is not in communication with said fluid passage when said valve ball is seated against said valve seat, and said output is in communication with said lower chamber;

further comprising a second fuel pressure regulator adapted to regulate the pressure at an input of said second fuel pressure regulator, said input of said second fuel pressure regulator coupled to receive fuel from said fuel pump before said first fuel pressure regulator;

further comprising an in-line fuel filter coupled between said fuel pump and said first fuel pressure regulator, and after said second fuel pressure regulator;

further comprising:

a check valve coupled between said fuel pump and said first fuel pressure regulator, and after said second fuel pressure regulator, said check valve oriented to prevent fuel flow through said check valve toward said fuel pump; and a pressure relief valve oriented to allow pressure relief for fuel above a predetermined pressure which would otherwise be blocked by said check valve.

4. A fuel delivery system as recited in claim 3, wherein said pressure relief valve is coupled in parallel with said check valve.

5. A fuel delivery system comprising:

a fuel pump;

a first fuel pressure regulator with an input and an output, said input coupled to receive fuel from said fuel pump;

at least one fuel injector coupled to receive fuel from said output of said fuel pressure regulator;

wherein said first fuel pressure regulator further comprises: an upper chamber and a lower chamber separated by a flexible diaphragm assembly; a fluid passage having a first end and a second end, said first end communicating with said lower chamber; a rigid member disposed within said fluid passage, said rigid member having a first end and a second end, said first end bearing against said diaphragm assembly, said rigid member further being porous to fluid flow through said fluid passage; a valve seat located at said second end of said fluid passage; a valve stopper bearing against said second end of said rigid member; a valve spring exerting a force on said valve stopper toward said valve seat; and a main spring exerting a force on said diaphragm assembly opposing movement of said diaphragm assembly toward said upper chamber; wherein said input is in communication with said fluid passage when said valve stopper is away from said valve seat and is not in communication with said fluid passage when said valve stopper is seated against said valve seat, said output is in communication with said lower chamber, and said rigid member is mechanically coupled to neither said diaphragm assembly nor said valve stopper;

further comprising a second fuel pressure regulator adapted to regulate the pressure at an input of said second fuel pressure regulator, said input of said second fuel pressure regulator coupled to receive fuel from said fuel pump before said first fuel pressure regulator;

further comprising an in-line fuel filter coupled between said fuel pump and said first fuel pressure regulator, and after said second fuel pressure regulator;

further comprising:

a check valve coupled between said fuel pump and said first fuel pressure regulator, and after said second fuel pressure regulator, said check valve oriented to prevent fuel flow through said check valve toward said fuel pump; and a pressure relief valve oriented to allow pressure relief for fuel above a predetermined pressure which would otherwise be blocked by said check valve.

6. A fuel delivery system as recited in claim 5, wherein said pressure relief valve is coupled in parallel with said check valve.

7. A fuel delivery system as recited in claim 1 wherein said first fuel pressure regulator has a port coupled to a pressure source switchable between atmosphere and manifold vacuum.

8. A fuel delivery system comprising:

a fuel pump having an outlet through which said fuel pump delivers fuel;

at least one fuel injector coupled to receive at least a portion of the fuel delivered from the outlet of said fuel pump;

a first fuel pressure regulator coupled to regulate fuel pressure to said at least one fuel injector;

a second fuel pressure regulator coupled to regulate fuel pressure at the outlet of said fuel pump;

wherein said first fuel pressure regulator has an input and an output, said fuel pressure regulator is adapted to regulate the pressure at its output, said input is coupled to receive said at least a portion of the fuel delivered from the outlet of said fuel pump;

wherein said second fuel pressure regulator is adapted to regulate the pressure at an input of said second fuel pressure regulator, said input of said second fuel pressure regulator is coupled to receive fuel from said fuel pump before said first fuel pressure regulator;

further comprising:

a check valve coupled between said fuel pump and said first fuel pressure regulator, and after said second fuel pressure regulator, said check valve oriented to prevent fuel flow through said check valve toward said fuel pump; and a pressure relief valve oriented to allow pressure relief for fuel above a predetermined pressure which would otherwise be blocked by said check valve.

9. A fuel delivery system as recited in claim 8 wherein said pressure relief valve is coupled in parallel with said check valve.

* * * * *